US006086344A

United States Patent [19]

White

[11] Patent Number: 6,086,344

[45] Date of Patent: Jul. 11, 2000

[54] HYDRAULIC MOTOR LUBRICATION PATH

[75] Inventor: Hollis N. White, Hopkinsville, Ky.

[73] Assignee: White Hydraulics, Inc., Hopkinsville, Ky.

[21] Appl. No.: 09/016,980

[22] Filed: Feb. 2, 1998

[51] Int. Cl.[7] ..... F01C 1/02

[52] U.S. Cl. ..... 418/61.3; 418/102; 418/77; 418/79

[58] Field of Search ..... 418/61.3, 102, 418/77, 79

[56] References Cited

U.S. PATENT DOCUMENTS 3,862,814 1/1975 Swedberg ..... 418/102
3,871,798 3/1975 Berlich ..... 418/61.3
3,873,248 3/1975 Johnson ..... 418/61.3
3,887,309 6/1975 Easton ..... 418/61.3
3,915,603 10/1975 Swedberg ..... 418/61.3

*Primary Examiner*—Thomas Denion
*Assistant Examiner*—Theresa Trieu
*Attorney, Agent, or Firm*—Lightbody & Lucas

[57] ABSTRACT

A lubrication path in a gerotor motor extending in the face of the rotor or an adjoining surface from a gerotor cell having relatively high pressure to the central cavity of the device to provide cooling and lubrication fluid thereto.

27 Claims, 9 Drawing Sheets

HYDRAULIC MOTOR LUBRICATION PATH

BACKGROUND OF THE INVENTION

Hydraulic pressure devices are efficient at producing high torque from relatively compact units. Their ability to provide low speed and high torque make them adaptable for numerous applications. U.S. Pat. Nos. 3,572,983, 4,285,643, 4,357,133 4,697,997 and 5,173,043 are examples of hydraulic motors.

In these devices the input/output mechanism, typically a drive shaft with bearings and a wobblestick, develop heat and residue such as sludge (from heat) and metal particles (from wear). A number of these devices therefor incorporate lubrication circulation paths to pass fluid continually over such input/output mechanism. Examples include U.S. Pat. No. 4,533,302 (which parasitically drains fluid outward off of each pressurized volume chamber), U.S. Pat. No. 4,390, 329 (which uses naturally occurring leakage), U.S. Pat. Nos. 3,749,195 and 4,480,972 (which use inactive seals), U.S. Pat. Nos. 3,572,983 and 4,362,479 (which use ball check valves) and U.S. Pat. No. 4,285,643 (which uses one of the two main fluid ports).

These prior art units, however, either require extensive machining or contaminate the hydraulic fluid prior to usage in the pressure mechanism.

The present invention eliminates these problems.

OBJECTS AND SUMMARY OF THE INVENTION

It is the object of the present invention to provide for a hydraulic motor having a rotational speed rotating valve;

It is another object of the present invention to provide for lubrication and cooling of the rotary drive parts of a hydraulic motor;

It is another object of the present invention to eliminate the need for a separate case drain for the hydraulic motor;

It is another object of the present invention to increase the efficiency of rotating valved hydraulic motors;

It is yet another object of the present invention to increase the adaptability of hydraulic motors;

Other objects and a more complete understanding of the invention may be had by referring to the drawings in which:

DETAILED DESCRIPTION OF THE INVENTION

Figure 1:
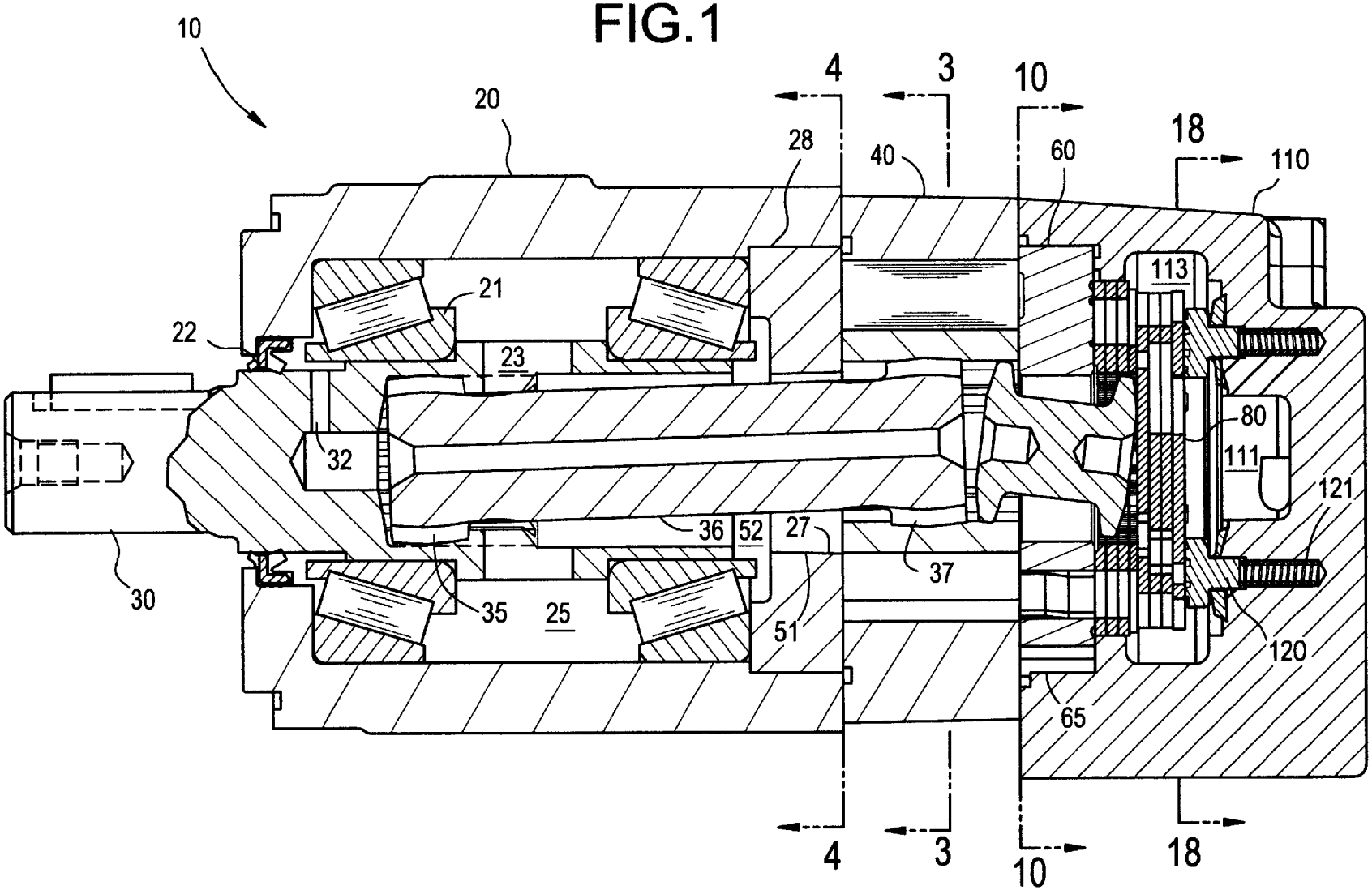
FIG. 1 is a longitudinal cross-sectional view of a hydraulic pressure device incorporating the invention of the application.

This invention relates to an improved pressure device. The invention will be described in its preferred embodiment of a gerotor pressure device having a rotating valve separate from the gerotor structure. As understood, this device will operate as a motor or pump depending on the nature of its fluidic and mechanical connections.

The gerotor pressure device 10 includes a bearing housing 20, a drive shaft 30, a gerotor structure 40, a manifold 60, a valving section 80 and a port plate 110.

The bearing housing 20 serves to physically support and locate the drive shaft 30 as well as typically mounting the gerotor pressure device 10 to its intended use (such as a cement mixer, mowing deck, winch or other application).

The particular bearing housing of FIG. 1 includes a central cavity 25 having two roller tapered bearings 21 rotatively supporting the drive shaft therein. A shaft seal 22 is incorporated between the bearing housing 20 and the drive shaft 30 in order to contain the operative hydraulic fluid within the bearing housing 20. Due to the later described integral case drain for the cavity 25 within the bearing housing 20 this shaft seal 22 can be a relatively low pressure seal. The reason for this is that the later described drain reduces the pressure of the fluid within the cavity 25 from full operational pressure, typically 2,000–4,000 PSI, down to a more manageable number, typically 100–200 PSI. The use of tapered roller bearings 21 in the pressure device encourages the movement of fluid within the cavity 25 due to the fact that the bearings 21 inherently will move fluid from their small diameter section to their large diameter section. This facilitates in the lubrication and cooling of the critical rotating components in the device. Two large diameter holes 23, some ⅝" in diameter, between the bearings 21 allow fluid to pass to the inside of the drive shaft 30 near to the drive connection to the later described wobblestick 36. In addition to the above, a series of radial holes 32 at the head end of the drive shaft further facilitates the movement of fluid within the cavity 25 across the bearings 21 (see U.S. Pat. No. 4,285,653 for a further explanation).

A wear plate 27 completes the bearing housing 20. This wear plate is a separate part from the bearing housing 20. As such, it can be made of different materials than the housing proper. Further, the wear plate 27 has a axial length slightly greater than the cavity 28 within which it is inserted (0.003" greater in the embodiment disclosed). This distance is selected such that the stator 41 of the later described gerotor structure 40 is in contact with the bearing housing 20 outside of the wear plate 27 upon the application of torque to the longitudinal assembly bolts holding the device 10 together. This allows the wear plate 27 to be axially clamped between the later described gerotor structure 40 and the remainder of the bearing housing 20, thus serving to reduce the leakage from the pressure cells of the gerotor structure. This improves the efficiency of the gerotor motor. The wear plate 27 in addition serves to hold the bearings 21 in place in respect to the bearing housing 20.

In the particular embodiment disclosed, the bearing housing 20 is made of machined cast metal while the wear plate 27 is a powder metal die pressed part. The inherent porosity of the wear plate allows oil impregnation so as to reduce friction and increase the service life of the unit.

The drive shaft 30 is rotatively supported within the bearing housing 20 by the bearings 21. This drive shaft serves to interconnect the later described gerotor structure 40 to the outside of the gerotor pressure device 10. This allows rotary power to be generated (if the device is used as a motor) or fluidic power to be produced (if the device is used as a pump). As previously described the radial holes 23 and the hole 32 drilled in the radial surface of the drive shaft 30 facilitate the movement of fluid throughout the cavity 25 thus to further increase the lubrication and cooling of the components contained therein.

The drive shaft 30 includes a central axially located hollow which has internal teeth 35 cut therein. The hollow provides room for the wobblestick 36 while the internal teeth 35 drivingly interconnect the drive shaft 30 with such wobblestick 36. Additional teeth 37 on the other end of the wobblestick drivingly interconnect the wobblestick 36 to the rotor 45 of the later described gerotor structure, thus completing the power drive connection for the device. A central hole drilled full length down the longitudinal axis of the wobblestick 36 is a possible addition to further facilitate fluid movement through the device.

The gerotor structure 40 is the main power generation apparatus for the pressure device 10.

The particular gerotor structure 40 disclosed includes a stator 41 and a rotor 45 which together define gerotor cells 47. As these cells 47 are subjected to varying pressure differential by the later described valve, the power of the pressure device 10 is generated. This occurs because the axis of rotation 46 of the rotor is displaced from the central axis 42 of the stator (the wobblestick 36 accommodates this displacement).

In the invention of this present application, there is a controlled leakage path along at least one flat surface of the rotor and/or an adjoining part between at least one relatively pressurized gerotor cell and the central area or cavity of the device (relatively pressurized means that the fluid pressure is sufficiently greater than that of the central area of the device that fluid will flow from the cell thereinto). This leakage path can be located on either or both of the adjoining surfaces. As the rotor 45 moves due to the orbiting motion of the rotor about the central axis 42 of the stator, the inner valleys 48 between the lobes of the rotor define an inner limit circle 49 on the adjoining part (see FIG. 21; Note that this inner limit circle 49 in the main FIGS. 1–20 of the preferred embodiment is shown substantially equal to the diameter of the central opening 51 of the wear plate 27. This is best seen in FIG. 1. The reason for this is that the actual difference between the two in the embodiment disclosed is only 0.018" (1.298" vs. 1.280"). In other devices the two might be more markedly different. See FIG. 21 for a more obvious distinction). This inner circle 49 defines the innermost extension swept by the valleys 48 between the rotor lobes (and thus the gerotor cells 47). In the invention of the present application, there are fluid passages 50 which extend from at least this inner circle 49 to the central area 52 within the pressure device 10. This allows an amount of fluid to be parasitically drawn off of the relatively higher pressure cells 47 to pass into the central area 52. This serves simultaneously to lubricate the critical moving components of the pressure device 10 in addition to providing a cooling function therefor.

Preferably there is a leakage path from at least one relatively higher pressure gerotor cell 47 (further preferably a plurality in sequence) to an opening no larger than this inner circle 49. While any higher pressure cell could be selected, it is preferred that a cell 47 located adjacent to a dead cell be utilized (a dead cell is a cell connected to neither port, a cell that if previously connected to higher pressure would retain such until connected to lower pressure). This provides a more fluid flow than the dead cell without significant loss in volumetric efficiency.

Figure 7:
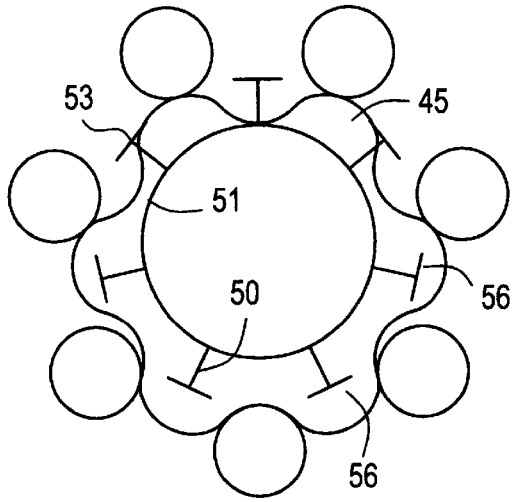
FIG. 7 is a representational view of the gerotor structure of FIG. 3 superimposed on the wear plate of FIG. 4 with a top dead center rotor positioning.

If the controlled leakage path is located in a stationary part (such as the wear plate), the path must extend outwards to at least the dead cell with the rotor located top dead center (as shown in FIG. 7). Ideally the outer extension of this leakage path extends for a distance less than that swept by the outer tips of the rotor lobes 44 so as to provide a seal for most of the high pressure in the device. The reason for this is to reduce the loss of volumetric efficiency that would occur if all cells were fluidically connected to the central area of the device (and also to each other via other leakage paths) although under certain circumstances such a connection may be desirable (for example small leakage paths and/or need for higher fluid flow).

Figure 6:
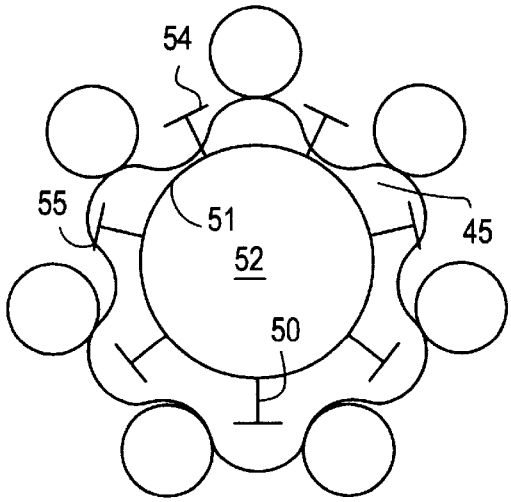
FIG. 6 is a representational view of the gerotor structure of FIG. 3 superimposed on the wear plate of FIG. 4 with a bottom dead center rotor positioning.

It is preferred that the leakage path also extend into an adjacent cell so as to insure a continual source of relatively higher pressure lubrication fluid (the cell at 10:30 in the bi-directional pressure device of FIGS. 1 and 7 assuming it is the next pressurized—in a known uni-directional pressure device only one would be needed). It is further preferred that the path extend such that with the rotor located bottom dead center (as shown in FIG. 6) adjacent paths extend into the cell in transition 54 (at 11:00 in FIG. 6), with the cross-over to a further cell 55 just starting to leak (at 9:30 in FIG. 6) (again assuming next pressurized). These additional connections, though not mandatory, facilitate the lubrication function of the device. Note that the inward extension of the leakage paths in a stationary part is not critical as long as it is sufficient to extend into the central cavity of the pressure device at the time that the leakage path is active. Additional inward extensions would not compromise the operation of the device.

In this preferred embodiment only 0.5 gal. per minute are being utilized. The number of cells having leakage paths are thus kept to a minimum to provide a continuous flow. This continuous flow provides a constant lubrication function.

Figure 21:
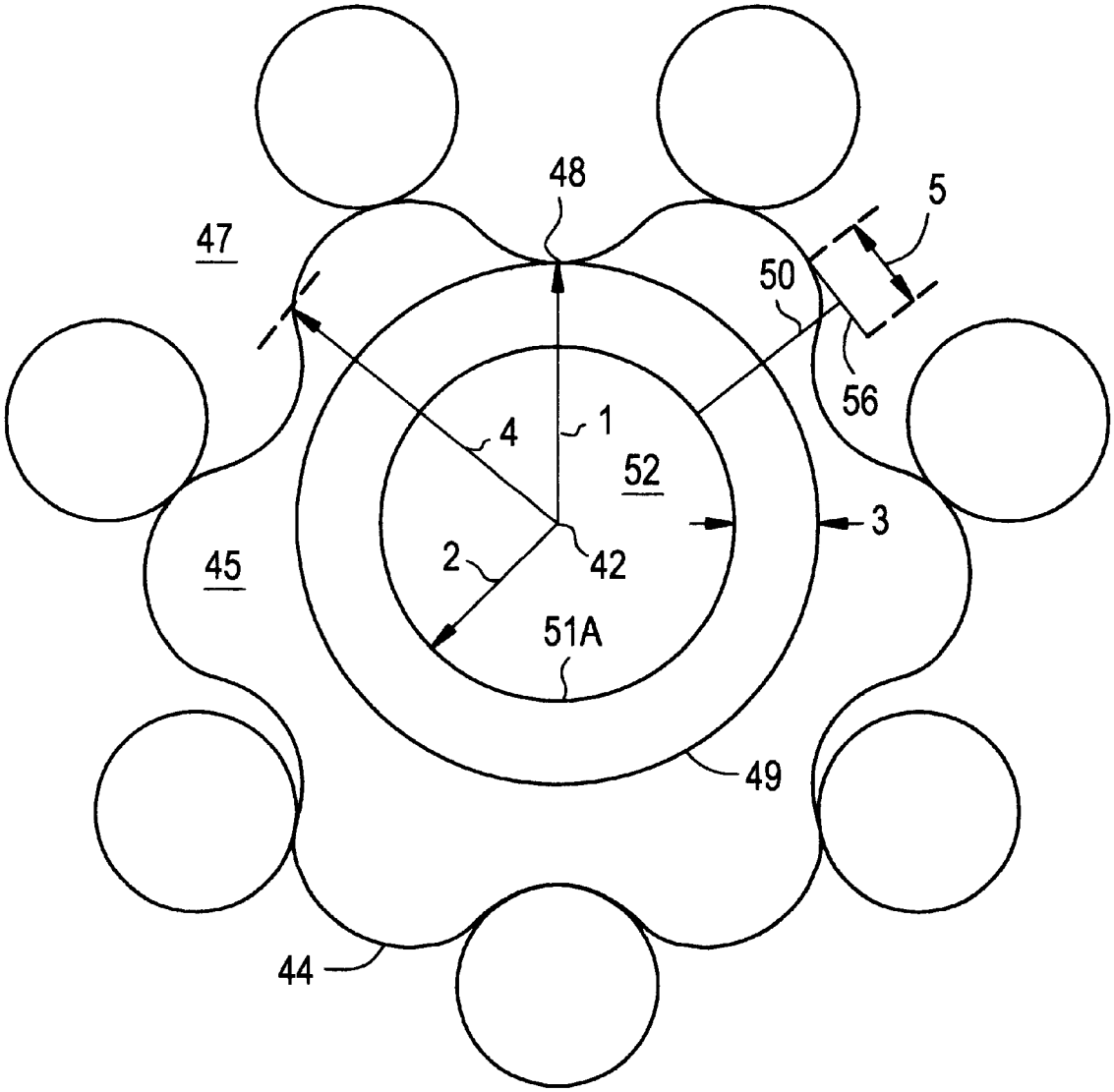

The parameters behind this leakage path are set forth in example form in FIG. 21. This figure is similar to FIG. 7 with the diameter 51A of the central area 52 reduced for clarity of explanation. The first parameter is the radius 1 of the inner limit circle 49 defined by the valleys 48 between rotor lobes 44. This radius 1 defines the inward extension of the gerotor cells 47 towards the central longitudinal axis 42 of the gerotor pressure device 10. The second parameter is the radius 2 of the central opening 51 defining the outer extent of the central area 52. This radius 2 defines the location to which the leakage passage 50 must extend to provide lubrication for such area 52. This radius 2 will vary considerably depending on the device. The leakage passage 50 itself extends from 49 to 51 (51A in FIG. 21) across distance 3 (i.e., radius 1 minus radius 2). Further extension outward from the inner limit circle 49 connects that leakage passage to its respective gerotor cell sooner and for a longer time (subject to a continual leakage if extended beyond the outer position of the rotor lobes 44). An example of this would be the extension of the passage 50 along vector 4. With this extension the respective gerotor cell would be interconnected to the central area 52 before becoming a dead pocket, and would be interconnected longer than it would have been had the extension along this vector 4 stopped at the inner limit circle 49. It is preferred to increase the lateral extension 56 (or to use multiple passages per cell) in combination with a moderate further outward extension so as to optimize lubrication without unduly compromising volumetric efficiency. (A similar factor could be adjusted by not having a passage for every gerotor cell.)

Figure 8:
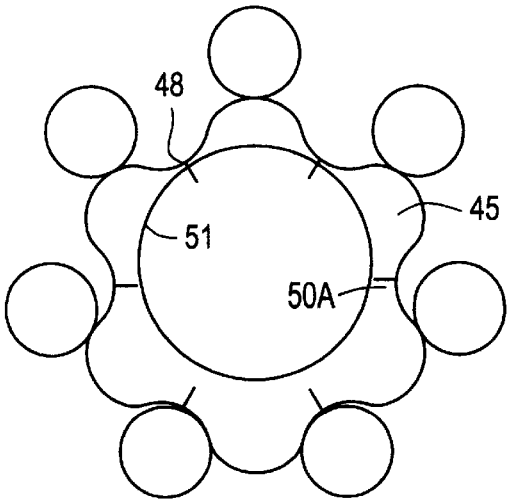
FIG. 8 is a representational view like FIG. 6 of the gerotor structure of FIG. 3 with lubrication fluid passages in the rotor instead of the wear plate.
Figure 9:
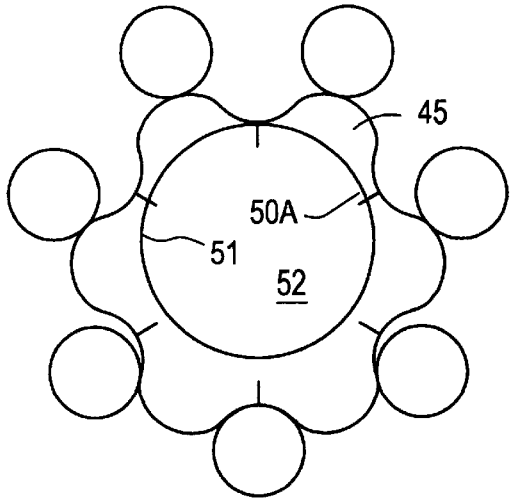
FIG. 9 is a representational view like FIG. 7 of the gerotor structure of FIG. 3 with lubrication fluid passages in the rotor instead of the wear plate.
Figure 10:
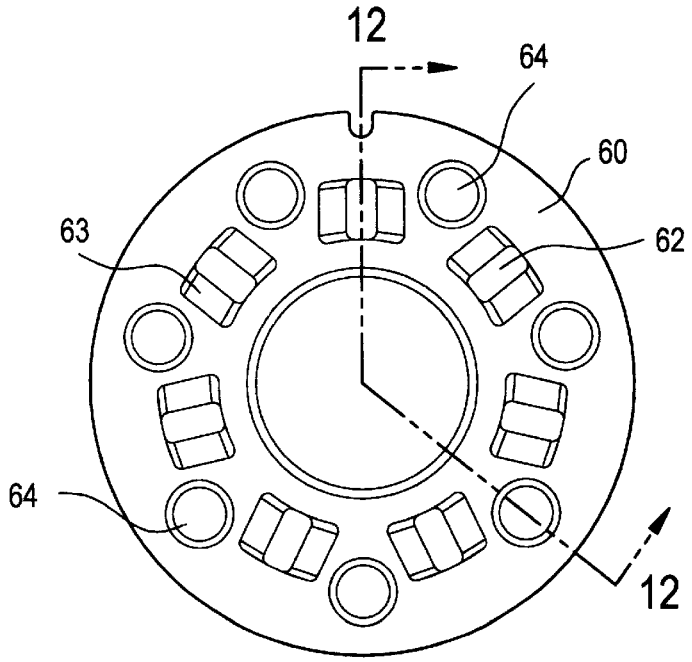
FIG. 10 is a face view of the manifold plate of the embodiment of FIG. 1 taken generally from lines 10—10 therein.
Figure 11:
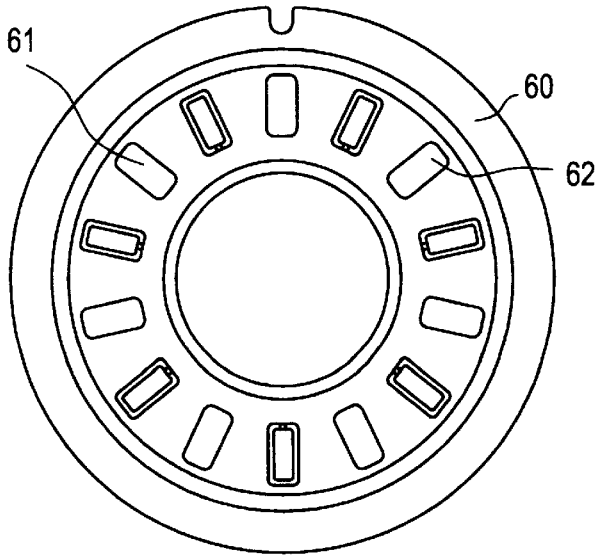
FIG. 11 is a lateral face view of the back side of the manifold plate of FIG. 10 taken generally along lines 11—11 in FIG. 12.
Figure 12:
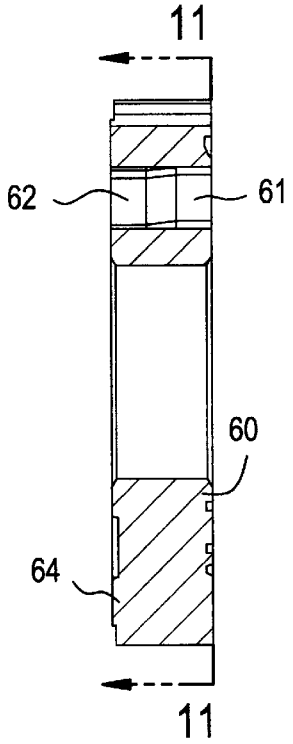
FIG. 12 is a lateral cross-sectional view of the manifold plate of FIG. 10 taken generally from lines 12—12 therein.
Figure 13:
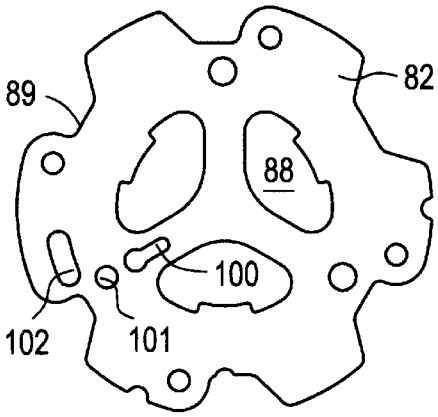
FIGS. 13–17 are selective cross-sectional views of the plates in the rotating valve of the gerotor device of FIG. 1.
Figure 14:
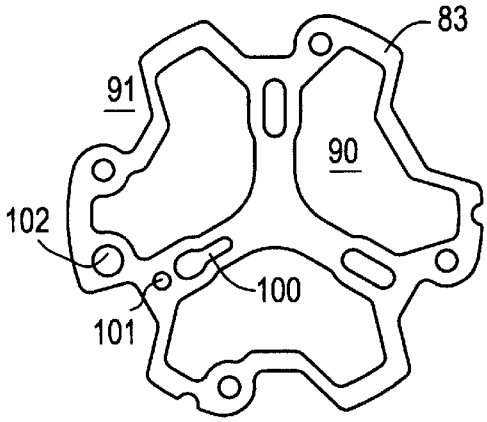
Figure 15:
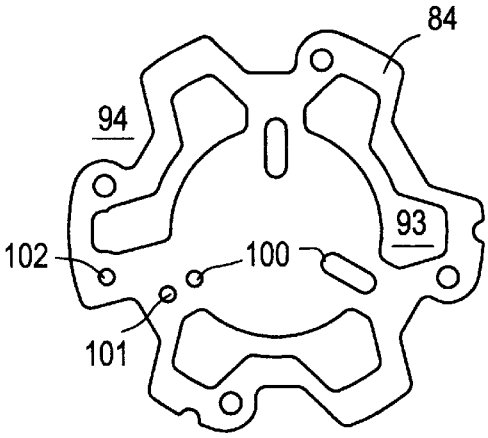
Figure 16:
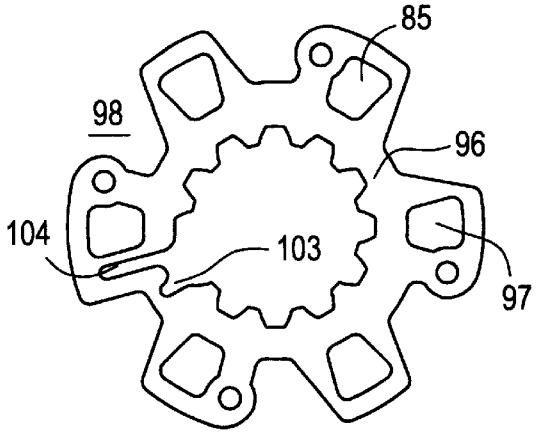
Figure 17:
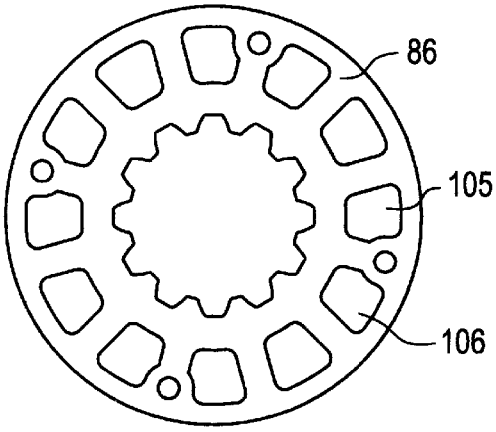
Figure 18:
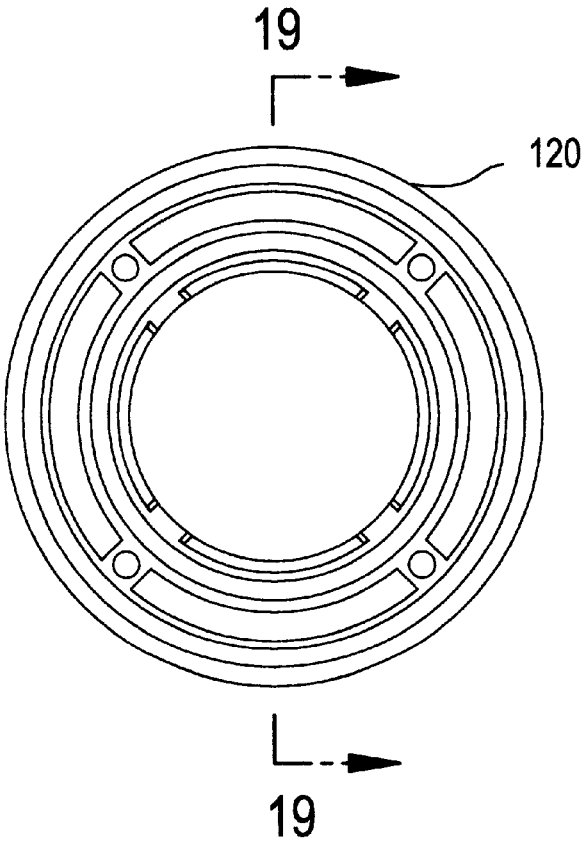
FIG. 18 is a surface view of the biasing piston of the device of FIG. 1 taken generally along lines 18—18 therein.
Figure 19:
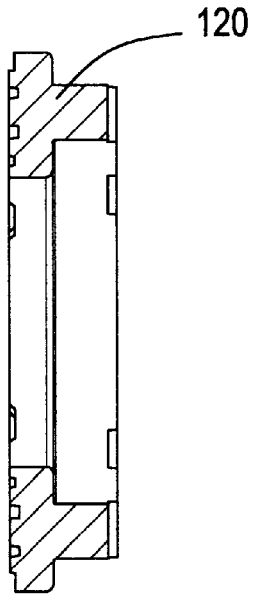
FIG. 19 is a cross-sectional view of the biasing piston of FIG. 18 taken generally along the lines 19—19 in such figure.
Figure 20:
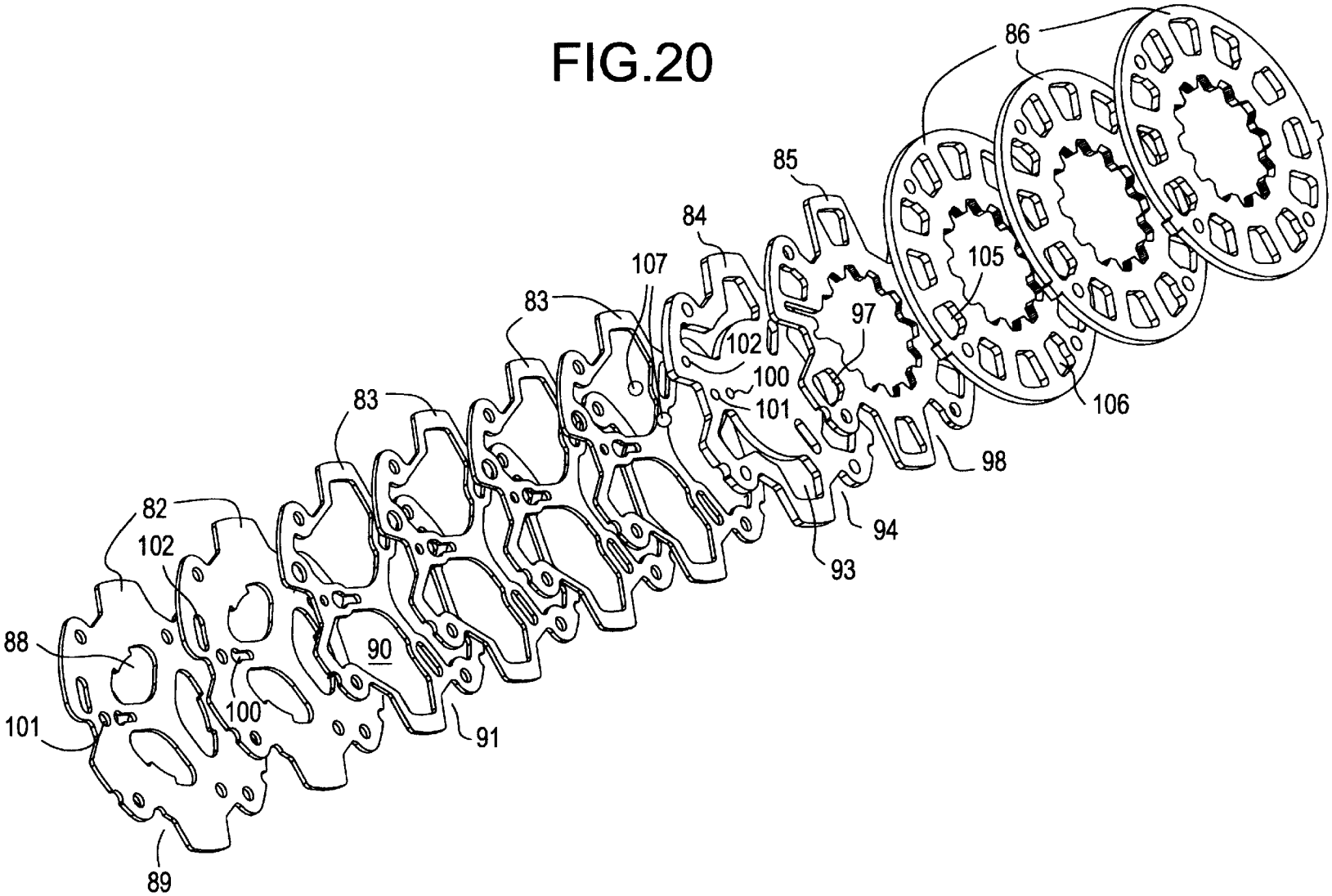
FIG. 20 is a perspective drawing showing the plates of the valve separated in proper order and number; and, FIG. 21 is a modified enlargement of FIG. 7 highlighting the preferred parameters of the invention.

The design technique is similar for the later described leakage passages in the rotor (FIGS. 8 and 9). The only difference is that the passages extend inward in the rotor from the rotor valleys 48 to central opening 51 (51A) to contact same. Preferably this is accomplished in the center of the valleys 48 so as to provide symmetrical bi-directional operation.

In the preferred embodiment of FIG. 1, the leakage passages 50 are "T" slots cut into the stationary wear plate 27 in line with the center of the gerotor pockets (see FIGS. 6 and 7). With the slots so positioned, there is one slot interconnected to the dead pocket in a top dead center position rotor (FIG. 7) with a second more active slot 53 leaking to the central area 52 of the pressure device (which slot depending on the fluidic pressure therein—again I have selected 53 for example). In a corresponding bottom dead center position (FIG. 6), there is one slot extending to a cell in transition 54 to a dead pocket and a second slot just starting to connect to a second more active cell 55 (again I have selected 54 and 55 respectively for example). In both instances there may be some minor back leakage to cells having lower pressure than the central area depending on relative pressures. However, due to the case drain, this leakage should be minimal.

The radial extension 56 at the outer end of the passages 50 allows for an increased amount of leakage to a particular cell over a longer period of time than would be possible with a straight laterally extending passage 50 (i.e. without the radial extension 56). This facilitates the continuity of the flow of the lubrication fluid into the central area 52 of the device. The length of this extension 56 can be adjusted so as to alter the time of connection to a particular cell and the number of cells connected, and thus the amount of leakage.

The location of the passages 50 in the wear plate 27 is preferred to a location in the later described manifold due to its relative proximity to the rotating parts of the gerotor pressure device 10 as well as its axial separation from the later described pressure release case drain mechanism in the rotating valve of the valving section 80. In other devices (such as one with a front case drain) the manifold may be preferable.

The particular wear plate disclosed is 3" in diameter and 0.650" thick. It includes a central opening of substantially 1.280" in diameter in addition to a surrounding bearing clearance groove of substantially 2" in diameter. There are seven recesses 29 substantially 0.375" in diameter and from 0.030–0.040" deep equally spaced around the diameter on a 2.3" diameter circle aligned with the central axis of the rolls 43 of the gerotor structure 40. There are in addition, seven balancing recesses 30 some 0.40" in width and 0.25" in depth equally spaced around the wear plate on the same diameter as the recesses 29. The depth of these balancing recesses 30 is the same as the recesses 29. In addition to the above, the passages 50 extend some 0.25" from the central opening in the wear plate some 0.020" in width and 0.020–0.025" in depth. The "T" section 56 at the top of these passages 50 extend for 0.260" in radial width and 0.020" in axial width. Again, the depth of these passages 50 is from 0.020–0.025" in depth. In differing devices with differing parameters, these dimensions would change.

In a gerotor hydraulic pressure device such as that shown, there are three basic pressure levels in the gerotor cells: one set of gerotor cells is connected to higher pressure, one set of gerotor cells is connected to lower pressure and one gerotor cell, the dead cell, is not connected to either higher or lower pressure. In the invention of the present application, the passages 50 parasitically drain off high pressure fluid from gerotor cells 47 which are subjected to relatively higher pressure than the central area, thus providing the desired lubrication and cooling fluid for the remainder of the device. In the preferred embodiment disclosed, this leakage occurs from the gerotor cell which is both subject to high pressure and in addition approaching its maximum volumetric size, thus producing the desired lubrication without overly compromising the volumetric efficiency of the pressure device. An example of this is seen in FIG. 6 wherein for example the cell 54 at 11:00 is interconnected to the passages 50 while the other high pressure cells at 7:30 and 9:30 are not (although as previously set forth the cell 55 at 9:30 is just beginning to be so connected). Due to the fact that these cells are pressurized at full operating pressure, some 2,000–4,000 PSI, while the central area 52 of the gerotor device is at a lower pressure, perhaps 200 PSI, fluid will readily flow through the passages 50 from this gerotor cell to the central area 52, thus providing the desired lubrication and cooling fluid.

FIG. 7 further demonstrates the invention, most particularly into the purpose of the "T" section 56 at the top of the passages 50. In specific, as can be seen in the cell 53 at substantially 10:30, due to the "T" section 56, there was an interconnection to the high pressure gerotor cells earlier than would occur if the device utilized the radially extending passages 50 alone. Thus the top sections of the "T" increase the dwell time for communication between the high pressure gerotor cells and the central area 52 of the gerotor device, thus ensuring a more continuous flow of lubrication and cooling fluid thereto. As with FIG. 6, the interconnections at 12:00 and 1:30 do not significantly reduce the volumetric efficiency of the gerotor motor due to the fact that these cells are dead (the cell at 12:00) or are interconnected to the area of relatively low pressure (the cell at 1:30). Note that in devices without a separate case drain the central area 52 of the gerotor pressure device 10 would be interconnected to the relatively low pressure port through these contracting gerotor cells—i.e. a backwards flow of fluid to the cells through the leakage paths 50 connected thereto. In some applications this may be useful despite the problems associated therewith (such as shorter gerotor structure service life).

Note that although the passages 50 are shown located in a stationary part, the wear plate 27, they could instead or in addition also be located in the rotor 45 as long as the same conditions are met—i.e. there is a leakage path from at least one relatively high pressure gerotor cell 47 into the central area 52 of the device. This could be accomplished by placing a small inwardly extending passages 50A within the rotor 45, preferably at the valley 48 of the lobes thereof, sufficiently long enough for at least one to extend into the central area 52 (opening 51 of the wear plate 27 shown) thus to provide for the desired leakage. Preferably at least two would be connected for reasons given in respect to the stationary embodiment.

An example of this latter construction is set forth in FIGS. 8 and 9 utilizing rotor positioning similar to FIGS. 6 and 7. In this unit, the passages 50A are located in the rotor 45 instead of in the wear plate 27. In this embodiment, the passages 50A extend from the valley 48 between two adjacent rotor lobes inward for a set distance. The set distance is selected such that at least one passage 50A interconnects to the central area 52 of the gerotor pressure device while the respective cell 47 contains relatively higher pressure. Extending the length of the passage 50A further inward would interconnect more cells 47 to the central area 52. It is preferred that these alternative passages 50A be oriented as shown to provide the same overall operation as the previously described FIGS. 6 and 7. In addition, increasing the width and depth of the passages would increase the amount of fluid passing from any particular cell 47 to the central area 52. In the embodiment disclosed, the passages 50A extend some 0.20" in length, and again are approximately 0.02" in width and 0.020–025" in depth.

It is preferred that some sort of case drain be provided in order to allow for an effective lubrication flow through the device. This case drain can be provided by a passage to a specific dedicated case drain port, by a series of valved passages to the later described inside and outside ports (the valve(s) insuring an interconnection to the port having the lower relative pressure) or otherwise as known in the art. In the preferred embodiment this case drain is provided by passages in the main valve 81 for the device (passages later described).

The manifold 60 in the port plate 100 serves to fluidically interconnect the later described valve to the gerotor cells 47 of the gerotor structure 40, thus to generate the power for the pressure device 10.

In the particular embodiment disclosed, since the valve is an rotating valve, phase compensation is not necessary. As such, the valving passages 62 can extend straight through the manifold 60. The particular manifold disclosed includes recesses 64 directly centered on the rolls 43 of the stator 41. These serve to reduce the axial pressure on such rolls 43 (corresponding recesses 29 in the wear plate 27 provide a similar function at the other end of the rolls 43). In addition, the manifold openings 63 are expanded at their interconnection with the gerotor cells 47 relative to the openings 61 of the valving passages 62 on the other side of such manifold (contrast FIG. 10 with FIG. 11). (Balancing recesses 30 in the wear plate 27 serve to partially equalize the pressure on the other side of the rotor 45.) As with the wear plate 27, the axial length of the manifold 60 is greater than the axial length of the cavity 65 in the port plate within which it is contained, again some 0.003" in the preferred embodiment disclosed. This serves to clamp the gerotor structure 40 with substantially equal pressure on both sides thereof, thus to reduce leakage and improve the overall efficiency of the pressure device. Similarly, the manifold 60 is of powder metal construction for reasons as previously explained.

The valving section 80 selectively valves the gerotor structure to the pressure and return ports.

The particular valve 81 disclosed is of multi-plate construction including a selective compilation of five differing plates (FIGS. 13–17, 20). The particular valve 81 is an eleven plate compilation of two communication plates 82, five transfer plates 83–84, a single radial transfer plate 85 and three valving plates 86. Due to the use of a multiplicity of plates, the cross-sectional area of each opening available for fluid passage is increased over that which would be available if only a single plate of each type was utilized.

The communication plate 82 contains a segmented inner area 88 which communicates directly to the inside port 111 in the port plate 110. The communication plate 82 also contains six outer areas 89 which are in communication with the outside port 113. The plate thus serves primarily to interconnect the valve 81 to the pressure and return ports of the gerotor pressure device 10.

In order to provide for the necessary alternating passages 105, 106 in the valving plates 86, the first and second transfer plates 83, 84 shift the fluid from the inner 88 and outer 89 areas.

The first transfer plate 83 contains a series of three first intermediate passages 90 which serve to begin to transfer fluid from the inner area 88 outwards. It also includes a series of six second outward passages 91 which communicate with the outer areas 89 in the communication plate to laterally transfer fluid. Since the outside port 113 directly surrounds the valve 81, these outward passages 91 also serve to interconnect to the outside port 113.

A second transfer plate 84 completes the movement of the fluid from the inner and outer areas of the communication plate 82. It accomplishes this by a series of three second intermediate passages 93 which serve to complete the radial movement of fluid from the inner area 88 of the communication plate 82. A set of third outer passages 94 interconnect with the second outward passage 91 in the transfer plate 83 to complete the lateral movement of fluid therefrom. Again, since the outside port 113 surrounds the valve, the third outer passages 94 also directly interconnects to the outside port 113.

The radial transfer plate 85 segments the second intermediate passages 93 so as to provide for the alternating valving passages in the valving plate 86. This is provided by cover sections 96 for the middle of such passages 93. This separates the two passages 97, 98 therein to initiate alternate placement thereof.

The valving plate 86 contains a series of alternating passages 105, 106 which terminate the inner 88 and outer 89 areas of the communication plate 82 to complete the passages necessary for the accurate placement of the valving openings in the device. In the valving plate 86 the first 105 of the alternating valving passages are thus interconnected to the inside port 111 while the second 106 of the alternating passages are connected to the outside port 113 by the previously described passages. The use of four valving plates 86 allows for a solid, reliable connection to the valve stick that rotates the valve 81.

As previously mentioned, in addition to the above valving function, the valving section 80 also includes a pressure release/case drain mechanism for the central area 52 of the gerotor pressure device.

The particular pressure release mechanism includes three through holes 100, 101, 102, with 100 and 102 containing a one way ball check valve. The holes 100, 101, 102 extend through the communication plate 82 and two transfer plates 83, 84. These holes allow for the passage of fluid through the valve 81 in addition to providing a physical location for the two ball check valves 107 contained within the holes 100, 102. (The later described balancing ring 120 retains the balls 107 in their respective holes.) The holes 100, 102 selectively interconnect the central area 52 to the inside port 111 or outside port 113 having the lowest relative pressure through the ball check valves. The radial and circumferential extensions of the holes 100, 102 reduces check ball chattering against the later described balancing ring 120 by allowing fluid bypass of the balls 107 when such are not seated on plate 84. This provides for a self-contained case drain for the central area 52 and cavity 25 of the hydraulic device, thus allowing the circulation of fluid therein as well as lowering the pressure thereof.

Of the three holes, the outermost 102 is interconnected to the outside port 113, the middle hole 101 sweeps the area covered by the lands of the later described balancing piston 120 while the inner hole 100 interconnects to the inside port 111. Due to the fact that the holes 100, 101, 102 are all connected to the central area by passages 103, 104 respectively (FIG. 16), the fluid in the central area 52 is free to flow to the port having the lowest relative pressure. The middle hole 101 is itself in continual unvalved communication between the lands on the surface of the later described balancing piston 120 in order to interconnect same to the central area 52 and, through it, to the case drain in the valve 81. By integrating these pressure release valves with the rotating valve, the overall complexity and cost of the gerotor pressure device is reduced. Other, types of case drains could be utilized with the invention.

The valve 81 is itself rotated by a valve stick interconnected to the rotor 45 and thus through the wobblestick 36 to the drive shaft. This provides for the accurate timing and rotation of the valve 81.

A balancing piston 120 on the port plate 110 side of the valve 81 separates the inside port 111 from the outside port 113, thus allowing for the efficient operation of the device. This balancing ring is substantially similar to that shown in the U.S. Pat. No. 3,572,983, Fluid Operated Motor. A series of springs located in pockets behind the balancing piston bias the piston against the valve 81 so as to reduce the chances of the axial separation of the valve 81 from either the manifold 60 or the piston 120.

The port plate 110 serves as the physical location for the valving section 80 in addition to providing a location for the pressure and return ports (not shown). It thus completes the structure of the gerotor pressure device 10.

Although the invention has been described in its preferred form with a certain degree of particularity, it is to be understood that numerous changes can be made without deviating from the invention as hereinafter claimed.

Figure 2:
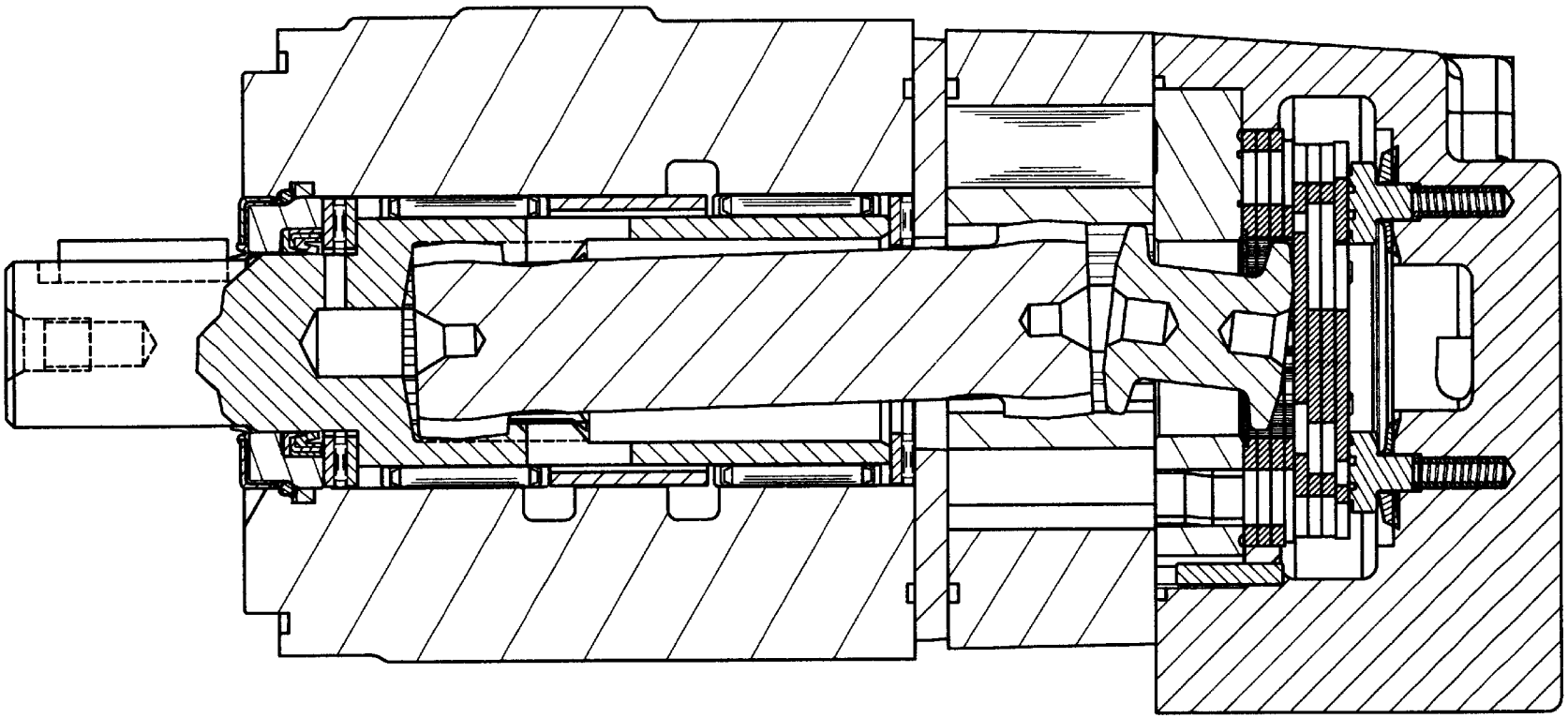
FIG. 2 is a longitudinal cross-sectional view of a alternate embodiment of a hydraulic motor incorporating the invention.
Figure 3:
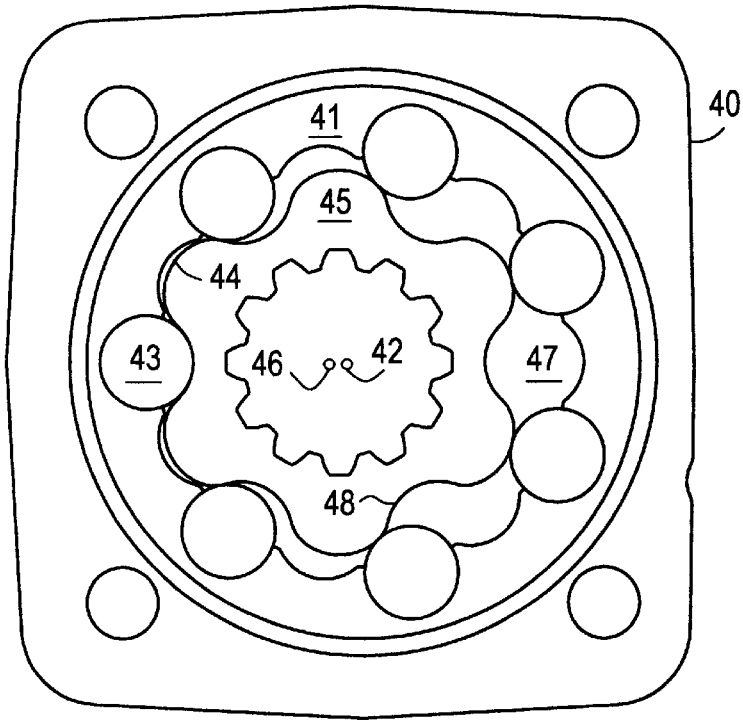
FIG. 3 is a lateral cross-sectional view through the hydraulic pressure generating gerotor structure of FIG. 1 taken substantially along the lines 3—3 in such figure.
Figure 4:
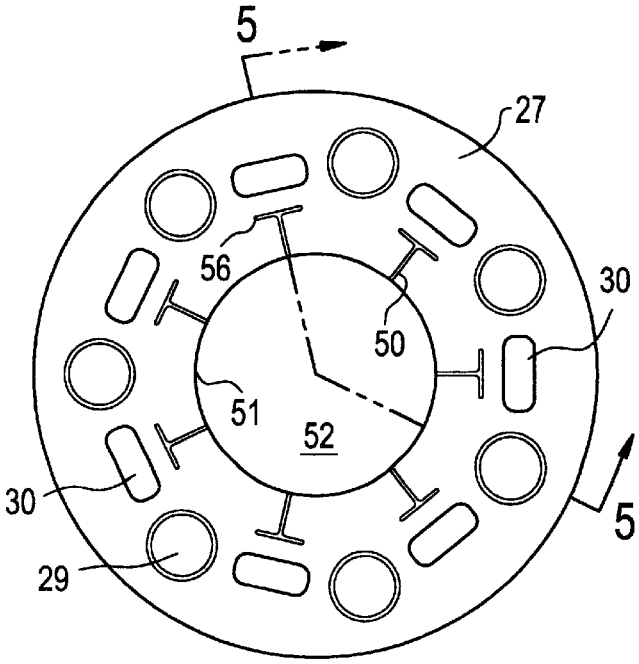
FIG. 4 is a face view of the wear plate of the embodiment of FIG. 1 taken generally from line 4—4 in this figure.
Figure 5:
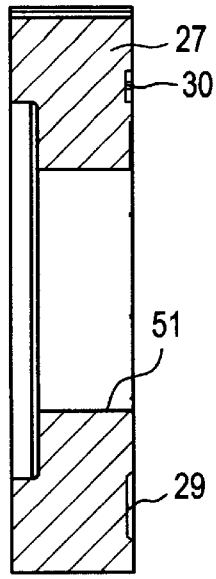
FIG. 5 is a cross-sectional view of the wear plate of FIG. 4 taken generally along line 5—5 in this figure.

An example of this is shown in FIG. 2 wherein the bearing housing 20 and the gerotor structure 40 are substantially identical to those used in the White Model RS Motor. The major difference is that in the White Model RS Motor, the drive shaft 30 is utilized as a rotary valve in combination with angular holes in the bearing housing 20 while FIG. 2 uses the valve of FIG. 1. The essential operation of the White Model RS Motor is set forth in the U.S. Pat. No. 4,285,643, Rotary Fluid Pressure Device. The major point of departure is the elimination of the use of the drive shaft for a valve and the elimination of certain machining steps on the bearing housing 20.

The invention is also amenable for incorporation in any fluidic device having chambers or cells with a higher relative pressure than other adjoining area. Hydraulic gerotor motor examples include the White Model RS of (U.S. Pat. No. 4,285,643, White Model RE (U.S. Pat. Nos. 4,357,133 and 4,877,383), the TRW M Series (U.S. Pat. No. 3,452,680), the Eaton devices (previously mentioned in the background section of this application) and other competitive units such as rotating rotor units, rotating stator units, orbiting stator units, and other devices: the invention is independent of the type of valving or other points of construction.

Other modifications are also possible without deviating from the invention as hereinafter claimed.

What is claimed:

1. A lubrication path for a gerotor motor having an orbiting rotor with a face contacting a surface of a housing, a central area in the housing substantially along the longitudinal axis thereof, and gerotor cells with at least one gerotor cell having relatively higher pressure than the central area, the lubrication path comprising a passage slot, said passage slot being cut in one of the face of the rotor or the surface of the housing, and said passage slot connecting the relatively higher pressure gerotor cell but not all gerotor cells to the central area.

2. The lubrication path of claim 1 wherein the gerotor device has a dead cell having relatively higher pressure and said passage slot connects at least said dead cell to the central area.

3. The lubrication path of claim 1 wherein the orbiting rotor is located adjacent to a stationary surface in the housing and said passage slot is located in the stationary surface in the housing.

4. The lubrication path of claim 1 wherein the rotor has a drive opening and lobes with a valley therebetween and characterized in that said passage slot extends in the face of the rotor from a valley towards the drive opening.

5. The lubrication path of claim 1 wherein the rotor has lobes with at least one valley therebetween, the orbiting of the rotor causing such valley to define an inner limit circle and such valley having a dead cell position in respect to the gerotor motor, and characterized in that said passage slot extends in the surface of the housing from at least the inner limit circle at the dead cell to the central area.

6. The lubrication path of claim 1 characterized in that said passage slot has an outer end and said outer end including a radially extending extension.

7. The lubrication path of claim 5 characterized in that said passage slot has an outer end and said outer end including a radially extending extension.

8. The lubrication path of claim 6 characterized in that said radially extending section is substantially centered relative to said passage slot.

9. The lubrication path of claim 1 wherein the motor has a valve axially spaced from the driveshaft and characterized by the addition of a case drain and said case drain including a passage through the valve.

10. The lubrication path of claim 1 characterized in that there are multiple gerotor cells and multiple passage slots respectively.

11. The lubrication path of claim 1 wherein the motor has a dead cell and characterized in that said passage slots connects at least to a gerotor cell adjacent to the dead cell.

12. The lubrication path of claim 10 wherein there are multiple cells having relatively higher pressure and only one said passage slots connecting at a given time.

13. The lubrication path of claim 11 wherein there are multiple cells having relatively higher pressure and multiple passage slots connecting at a given time.

14. A lubrication path for a gerotor motor having a stator, an orbiting rotor with a face contacting a surface of a housing, the rotor having lobes with at least one valley therebetween, the orbiting of the rotor causing such valley to define an inner limit circle, a central area in the housing having an opening substantially along the longitudinal axis of the housing, and gerotor cells with at least one gerotor cell having relatively higher pressure than the central area, the lubrication path comprising a passage, said passage being located in one of the face of the rotor or the surface of the housing, said passage extending from at least the inner limit circle to the opening of the central area, and said passage connecting the relatively higher pressure gerotor cell but not all gerotor cells to the central area.

15. The lubrication path of claim 14 wherein the gerotor device has a dead cell having relatively higher pressure and said passage connects at least said dead cell to the central area.

16. The lubrication path of claim 14 wherein the orbiting rotor is located adjacent to a stationary surface in the housing and said passage is located in the stationary surface in the housing.

17. The lubrication path of claim 14 characterized in that said passage extends in the face of the rotor from a valley.

18. The lubrication path of claim 14 characterized in that said passage has an outer end and said outer end including a radially extending extension.

19. The lubrication path of claim 14 wherein the motor has a valve axially spaced from the driveshaft and characterized by the addition of a case drain and said case drain including a passage through the valve.

20. The lubrication path of claim 14 characterized in that there are multiple gerotor cells and multiple passages respectively.

21. The lubrication path of claim 14 wherein the motor has a gerotor cell located adjacent to the dead cell and characterized in that by the addition of a second passage, said second passage being located in one of the face of the rotor or the surface of the housing, said second passage extending from outward of the inner limit circle to the opening of the central area at the gerotor cell located adjacent to the dead cell, and said second passage connecting the gerotor cell adjacent to the dead cell to the central area.

22. A lubrication path for a gerotor motor, the gerotor motor having a housing with a central area, a stator combining with an orbiting rotor to create expanding and contracting gerotor cells, the rotor having inner valleys between lobes with the orbiting of the rotor causing the inner valleys to define an inner limit circle, the housing having a surface adjoining the rotor, gerotor cells with at least one gerotor cell having a relatively higher pressure than the central area in the housing per orbit of the rotor, the lubrication path comprising a multiplicity of passages, said passages being in the surface of the housing adjoining the rotor, and said passages extending from the central area of the housing to at least the inner limit circle so as to connect a gerotor cell having a relatively higher pressure but not all gerotor cells to the central area.

23. The lubrication path of claim 22 wherein the gerotor cells have centers and characterized by the addition of said passages being located substantially in line with the centers of their respective gerotor cells.

24. The lubrication path of claim 22 wherein there is a gerotor cell located adjacent to a dead cell in a certain positioning of the rotor in respect to the stator and characterized in that said passages extend beyond said inner limit circle so as to interconnect to the gerotor cell located adjacent to the dead cell in the certain positioning of the rotor in respect to the stator.

25. The lubrication path of claim 22 characterized in that said passages have ends, radial extension passages, and said radial extension passages extending off of said ends of said passages.

26. The lubrication path of claim 22 wherein the central area has an opening on the surface of the housing, the opening having an outer radius, the inner limit circle having an inner radius, and said passages extending on the surface from inside the inner radius to outside of said outer radius.

27. The lubrication path of claim 26 wherein the rotor has lobes with tips defining an outer limit circle on orbiting of the rotor and characterized in that said passages do not extend in the surface to the outer limit circle.

* * * * *